US012042069B2

(12) United States Patent
Sutherland

(10) Patent No.: US 12,042,069 B2
(45) Date of Patent: Jul. 23, 2024

(54) SELF-BALANCING FLATWARE

(71) Applicant: Melanie Sutherland, Long Beach, CA (US)

(72) Inventor: Melanie Sutherland, Long Beach, CA (US)

( * ) Notice: Subject to any disclaimer, the term of this patent is extended or adjusted under 35 U.S.C. 154(b) by 0 days.

(21) Appl. No.: 16/737,686

(22) Filed: Jan. 8, 2020

(65) Prior Publication Data

US 2021/0204733 A1 Jul. 8, 2021

(51) Int. Cl.
*A47G 21/04* (2006.01)
*A47G 21/02* (2006.01)

(52) U.S. Cl.
CPC ..... *A47G 21/04* (2013.01); *A47G 21/02* (2013.01); *A47G 2400/025* (2013.01)

(58) Field of Classification Search
CPC ..... A47G 21/02; A47G 21/04; A47G 21/045; A47G 2400/025; A47J 43/28; A47J 43/281; A47J 43/282; A61J 7/0023
USPC ..... 30/142, 147–150, 298.4, 322–328; D7/643, 653, 656
See application file for complete search history.

(56) References Cited

U.S. PATENT DOCUMENTS 116,412 A * 6/1871 Chapman ..... B26B 3/00 30/298.4
260,157 A * 6/1882 Brower ..... B26B 3/00 30/298.4
3,968,591 A * 7/1976 Pearson, Jr. ..... A47G 21/04 30/324
D240,790 S * 8/1976 Daenen ..... D7/653
D263,272 S * 3/1982 Jagger ..... D7/664
D274,971 S * 8/1984 Kelley ..... D7/656
D294,391 S * 2/1988 Woo ..... D7/656
4,779,344 A * 10/1988 Panisch ..... A47G 21/02 30/324
4,993,156 A * 2/1991 Craven ..... A47J 43/281 30/324
D329,948 S * 10/1992 Hanner ..... D21/613
(Continued)

FOREIGN PATENT DOCUMENTS

EP 2130462 A1 * 12/2009 ..... A47G 21/02
FR 928047 A * 11/1947 ..... A47G 21/02
(Continued)

*Primary Examiner* — Jason Daniel Prone
(74) *Attorney, Agent, or Firm* — Innovent Law, P.C; Karima Gulick

(57) ABSTRACT

A flatware including a head portion, a base portion, a handle connecting the head portion to the base portion, a plurality of supporting elements supported by an outside surface, the plurality of supporting elements coupled the handle and/or the base portion. The flatware is in a weighted state when the head portion is holding a food or a fluid. The flatware is in a relaxed state when the head portion is empty. The base portion and the plurality of supporting elements hold the head portion in equilibrium and spaced away from the outside surface in both the weighted state and in the relaxed state. Two or more pieces of flatware can be stacked on top of one another. When stacked, the plurality of supporting elements and the base portion hold the flatware in equilibrium. When stacked, the head portions are spaced from one another and from the outside surface.

4 Claims, 6 Drawing Sheets

(56) References Cited

U.S. PATENT DOCUMENTS 5,187,829 A * 2/1993 Atkins ..... A46B 5/00 15/143.1
D347,147 S * 5/1994 Harrison ..... D7/656
5,590,472 A * 1/1997 Yaakov ..... A47G 21/02 30/327
5,695,084 A * 12/1997 Chmela ..... A47G 21/04 D9/436
5,860,190 A * 1/1999 Cano ..... A47G 21/02 30/327
6,234,162 B1 * 5/2001 Wenker ..... F24B 1/202 30/323
6,363,568 B1 * 4/2002 Harrison ..... A47G 21/02 15/167.1
D486,265 S * 2/2004 Olsen ..... D7/653
D531,827 S * 11/2006 Jelmoni ..... D7/653
D549,526 S * 8/2007 Tanguy ..... D7/653
D649,398 S * 11/2011 Greiner ..... D7/653
D652,252 S * 1/2012 Greiner ..... D7/653
D653,500 S * 2/2012 Greiner ..... D7/653
D676,286 S * 2/2013 Lion ..... D7/653
8,769,832 B1 * 7/2014 Joyner ..... A47G 21/02 30/322
8,839,522 B2 * 9/2014 Walters ..... A47G 21/06 30/322
D723,869 S * 3/2015 Joseph ..... D7/653
D736,039 S * 8/2015 Donovan ..... D7/653
D739,185 S * 9/2015 Donovan ..... D7/653
D739,684 S * 9/2015 Donovan ..... D7/653
D747,632 S * 1/2016 Shim ..... D7/653
D747,934 S * 1/2016 Shim ..... D7/653
D758,141 S * 6/2016 Spagnolo ..... D7/653
9,445,691 B1 * 9/2016 Joyner ..... A47J 43/28
D770,241 S * 11/2016 Shim ..... D7/653
D771,445 S * 11/2016 Shim ..... D7/653
D778,689 S * 2/2017 Grewal ..... D7/653
D793,173 S * 8/2017 Perez ..... D7/643
9,888,797 B2 * 2/2018 Edry ..... A47G 21/04
D832,663 S * 11/2018 Kopke ..... D7/653
D840,769 S * 2/2019 Malcolm ..... A47G 21/04 D7/656
10,413,103 B1 * 9/2019 Balanchi ..... A47G 21/04
D895,979 S * 9/2020 Burris ..... D4/107
2004/0060572 A1 * 4/2004 Olsen ..... A45D 2/48 132/217
2005/0028386 A1 * 2/2005 Hughes ..... A47J 43/28 30/327
2007/0084063 A1 * 4/2007 Hughes ..... A47J 43/28 30/327
2007/0214650 A1 * 9/2007 Tomazini ..... A47G 21/02 30/324
2009/0133940 A1 * 5/2009 Woods ..... G01G 19/56 30/327
2012/0297628 A1 * 11/2012 Rayko ..... A47G 21/02 30/327
2013/0133206 A1 * 5/2013 Donovan ..... A47G 21/02 30/298.4
2015/0143703 A1 * 5/2015 Nair ..... A47G 21/02 30/147
2016/0242584 A1 * 8/2016 Ramshaw ..... A47G 21/02
2017/0202383 A1 * 7/2017 Yew ..... A47G 21/02
2017/0347821 A1 * 12/2017 Leopold ..... A47G 21/02
2018/0000267 A1 * 1/2018 Kim ..... A47G 21/04
2018/0042416 A1 * 2/2018 Kopke ..... A47G 21/02
2019/0183272 A1 * 6/2019 Malcolm ..... A47G 21/04
2019/0298090 A1 * 10/2019 Stevenson ..... A47G 21/04
2019/0335931 A1 * 11/2019 Ribi ..... A47G 21/04
2021/0007519 A1 * 1/2021 Chang ..... A47G 21/04

FOREIGN PATENT DOCUMENTS

FR 2737399 A1 * 2/1997 ..... A47G 21/02
FR 2891127 A1 * 3/2007 ..... A47G 21/02
FR 2954726 B1 * 11/2012 ..... B26B 9/00
JP 2009297113 A * 12/2009 ..... A47J 43/28
JP 4776101 B2 * 9/2011 ..... A47G 2400/025
JP 2014171817 A * 9/2014 ..... A47G 2400/025
WO WO-9006709 A1 * 6/1990 ..... A47G 21/02

* cited by examiner

SELF-BALANCING FLATWARE

BACKGROUND OF THE INVENTION

1. Field of the Invention

The present disclosure relates generally to flatware and serving utensils, and more particularly to a self-balancing and stackable flatware where the head of the spoon does not touch an outside surface even when the flatware contains food.

2. Description of the Related Art

Many restaurants and homes use reusable flatware where the flatware inevitably comes into contact with a table, kitchen counter or other external surface that is sometimes full of germs. Oftentimes, the portion that holds the food and gets place inside a user's mouth is the same portion that comes into contact with unhygienic outside surfaces. Users then use that same flatware to eat their food thereby contaminating the food itself.

In addition, cafes, bakeries, restaurants, caterers and grocery stores often offer samples or small bite sizes that have to be served on a plate for solid food or little cups for fluids. Currently, there are no solutions that allow for a reusable sample, small bite food holder that is reusable and hygienic.

To overcome at least some of the foregoing disadvantages, people try to leave their utensils on their plates or serving napkins, making the napkins not usable for their intended purpose. It is therefore desired to provide a flatware capable of more efficiently and hygienically serve food. Ideally, that flatware also needs to be reusable, ergonomic and light enough for a user to use comfortably.

As will be disclosed below, the present disclosure addresses these needs. Currently, there are no useful alternatives that effectively offer flatware that is hygienic and where the food holder does not come into contact with external surfaces, reusable, ergonomic and light enough for a user to use comfortably. As will be disclosed below, the present disclosure addresses these needs and covers a flatware to prevent these inconveniences and solve these issues.

SUMMARY OF THE DISCLOSURE

The present disclosure provides a flatware that suspends the serving portion of the flatware away from a table, counter or external surface so that the head portion of the flatware is kept away from unhygienic surfaces while still allowing use of the flatware for its intended function. In one embodiment, the present invention provides a flatware which comprises a head portion, a base, a handle which connects the head portion to the base, and one or more supporting elements which can rest on a table, counter or outside surface. These supporting elements are also supported by the outside surface. The supporting elements connect to the handle of the flatware and/or to the base of the flatware. When the flatware contains food or a fluid, it is said to be in a weighted state. When the flatware is empty and does not contain food or fluids, it is said to be in a relaxed state. In either the relaxed or weighted state, the head portion never comes into contact with an external outside surface such that the head portion which users put in their mouths does not come into contact with unhygienic surfaces. The base and supporting elements of the flatware hold the head portion in balance and equilibrium whether the head portion contains food or not and away from the outside and external surface such as a table, counter or serving surface.

In one embodiment of the present disclosure, two or more flatware of a relatively similar shape are stackable together, and even when stacked together, the head portion of the flatware does not come into contact with the external surface or outside table or counter.

Before explaining the various embodiments of the invention in detail, it is to be understood that the invention is not limited in its application to the details of construction and to the arrangements of the components set forth in the following description or illustrated in the drawings. Rather, the invention is capable of other embodiments and of being practiced and carried out in various ways. Also, it is to be understood that the terminology employed herein is for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

For a better understanding of the invention, its operating advantages and the specific objects attained by its uses, reference should be made to the accompanying drawings and descriptive matter in which there are illustrated preferred embodiments of the invention.

Various objects, features, aspects and advantages of the present embodiment will become more apparent from the following detailed description of embodiments of the embodiment, along with the accompanying drawings in which like numerals represent like components.

BRIEF DESCRIPTION OF THE DRAWINGS

It should be noted that the drawing figures may be in simplified form and might not be to precise scale.

The same elements or parts throughout the figures of the drawings are designated by the same reference characters, while equivalent elements bear a prime designation.

DETAILED DESCRIPTION OF THE INVENTION

The embodiment and various embodiments can now be better understood by turning to the following detailed description of the embodiments, which are presented as illustrated examples of the embodiment defined in the claims. It is expressly understood that the embodiment as defined by the claims may be broader than the illustrated embodiments described below. Many alterations and modifications may be made by those having ordinary skill in the art without departing from the spirit and scope of the embodiments.

Figure 1:
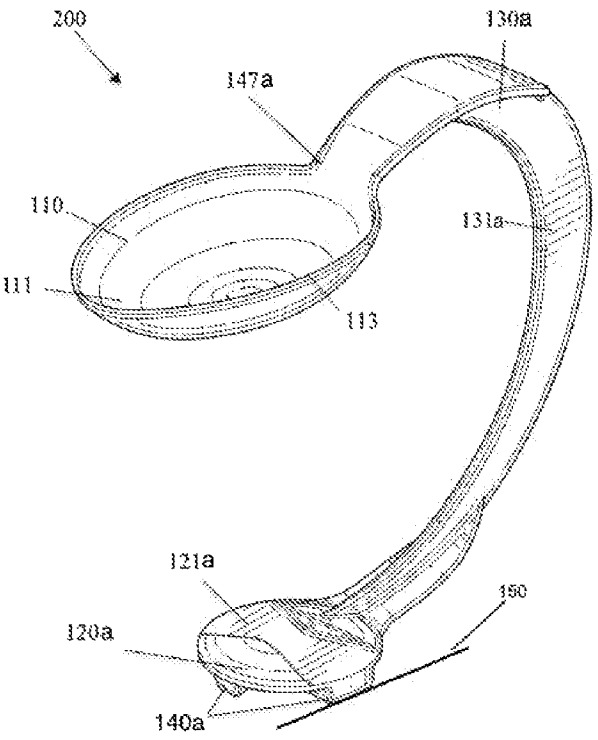
FIG. 1 is a perspective view of one embodiment of the present invention.
Figure 5:
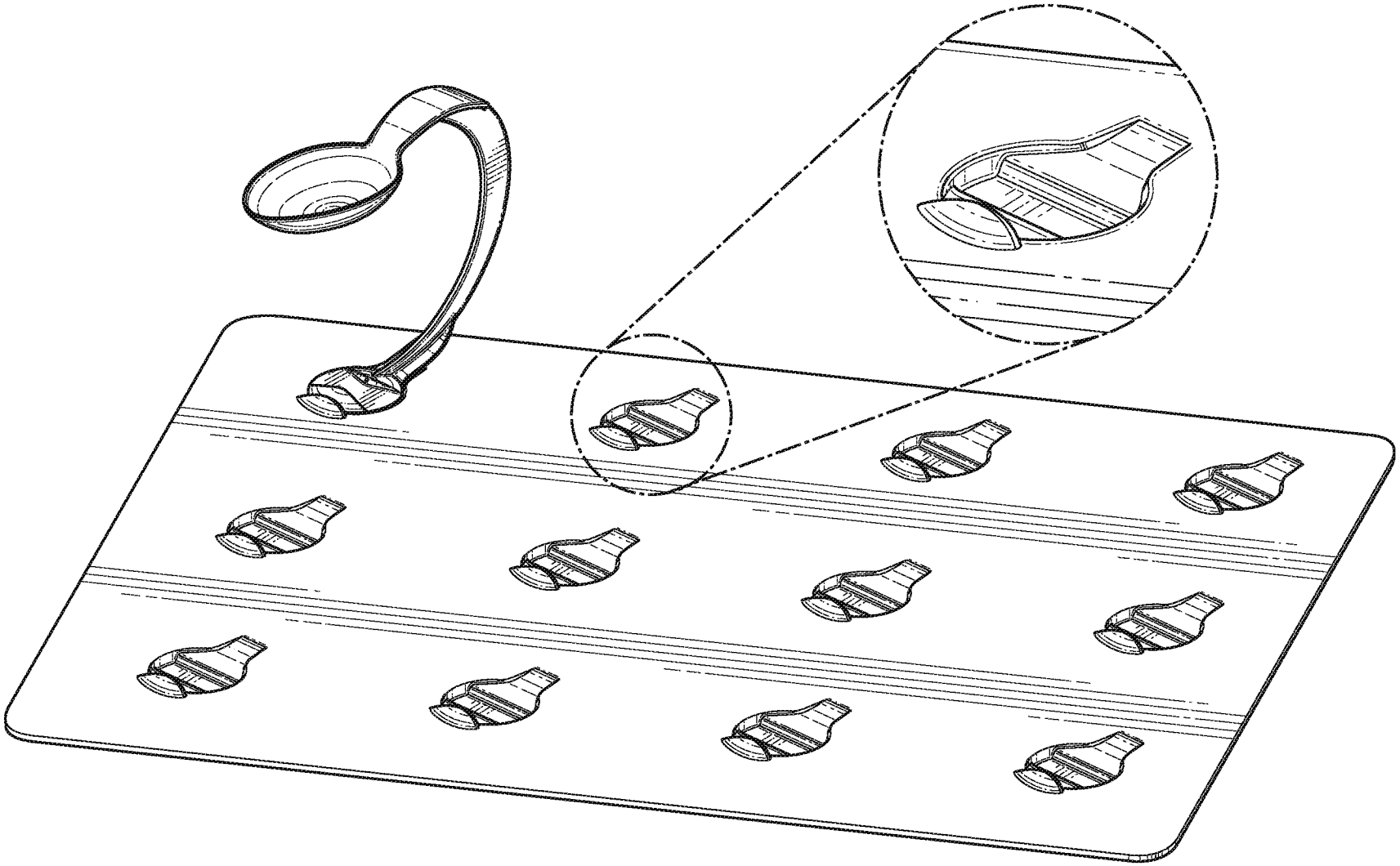
FIG. 5 shows a top perspective view of an alternative embodiment of the present invention on a serving tray.
Figure 6:
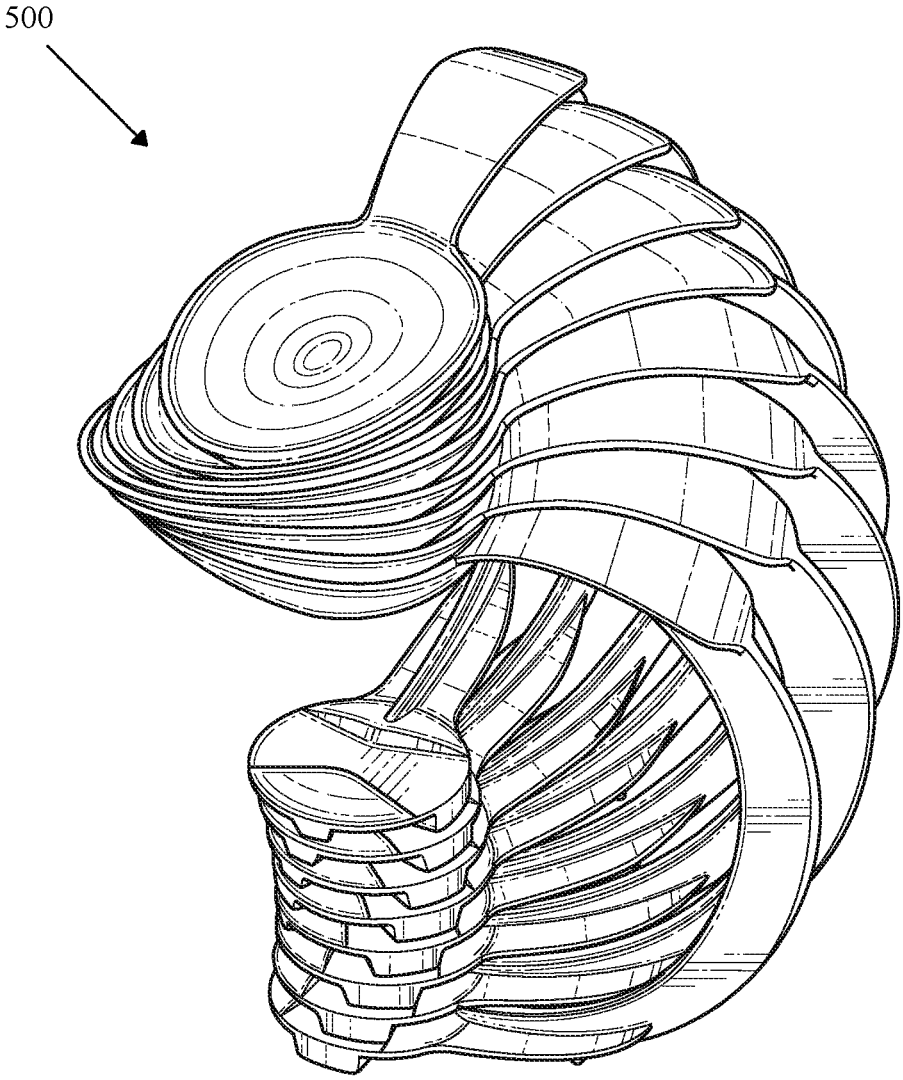
FIG. 6 is a perspective view of a kit of stacked flatware.

Referring now to the drawings and the characters of reference marked thereon, FIG. 1 shows one embodiment of a flatware 100 which includes a head portion 110, a base portion 120*a* and a handle portion 130*a*. The handle portion 130*a* connects the head portion 110 to a base portion 120*a*. In this embodiment, a few supporting elements 140*a* are resting and supported by a surface 150. While the surface 150 or outside surface 150 is not depicted in this embodiment, the surface 150 may be a table, a counter, a plate, a serving tray as shown in FIG. 5 or any other flat external surface where the flatware can rest.

In one embodiment, the supporting elements 140*a* are connected to the handle portion 130*a* of the flatware and to the base. In other embodiments, the supporting elements 140*a* are connected to just the handle portion 130*a* whereas in other embodiments, the supporting elements 140*a* are connected just to the base.

In a particular embodiment, when the flatware contains and holds food or fluids, the flatware is said to be in a weighted state 300, whereas when the flatware is empty and does not hold food or fluids, the flatware is said to be in a relaxed state 200. In either state of this particular embodiment, the head portion 110 never comes into contact with an external and outside surface 150. In one embodiment, the head portion 110 never comes into contact with an external and outside surface 150 thanks to the supporting elements 140*a* and a base portion 120*a*. These supporting elements 140*a* and base portion 120*a* also help maintain the flatware in equilibrium when the flatware either contains food or is empty.

In one particular embodiment, and as shown in FIGS. 1 through 4, the entire flatware (or spoons in this particular case) is made of the same material throughout and is flush throughout the flatware. In another embodiment, the head portion 110, the base, the handle portion 130*a* and the plurality of supporting elements 140*a* are formed of a same material and is the same part made of the same material and is flush throughout, not connected parts of the same material. In other embodiments, the various elements such as base portion 120*a*, head portion 110, supporting elements 140*a* and handle portion 130*a* are made of the same material and coupled together whereas in other embodiments, the elements are made of different materials but are flush throughout the flatware. In one particular embodiment, the flatware is 3D printed.

While the figures show the flatware as a spoon, the flatware may be a knife, fork or spork.

Figure 2:
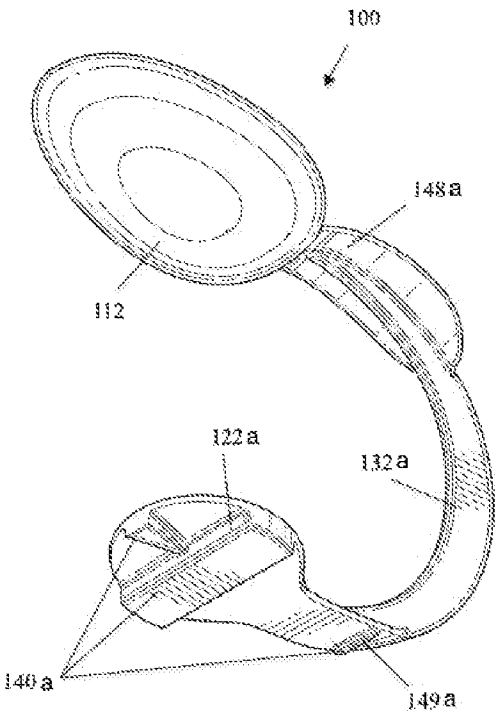
FIG. 2 is a bottom perspective view of FIG. 1.

FIGS. 1 and 2 show a flatware where the base portion 120*a* has an upper surface 121*a* and a lower surface 122*a*. In this particular embodiment, the lower surface 122*a* also includes a protrusion and a tab that are engageable with an outside surface 150 such as a table, serving tray or kitchen counter. In this embodiment, the flatware is a spoon where the head portion 110 forms a bowl 111 and includes a back 112 and an inside 111 opposite that back 112. The back 112 and the inside 111 meet at a defining tip portion 113 of the head. In one embodiment, the handle portion 130*a* forms a curved member 131*a* which has a neck 147*a* and a shoulder 149*a* which is located on the opposite side of the neck 147*a*. Here, the neck 147*a* is attached to the head portion 110 and is spaced apart from the tip portion 113. While in this embodiment, the shoulder 149*a* is part of the base portion 120*a*, the shoulder 149*a* may be located on the handle portion 130*a* instead or on other parts of the flatware which are not the base portion 120*a*.

In one embodiment, the head portion 110 is vertically suspended over the base portion 120*a* or part of the base portion 120*a* such that the inside of the bowl 111 opens up upwardly and away from the base portion 120*a* and the upper portion of the base portion 120*a*. In other embodiments, the head portion 110 is vertically suspended but not directly over the base portion 120*a*.

In one embodiment, the flatware includes a base having an upper surface and a lower surface structurally configured to be engageable with the outside surface 150 of another flatware. In a particular embodiment, the head portion 110 forms a bowl and has a back side 112 and an inside 111 opposite the back side 112 and defining tip portion 113. The handle portion 130*a* forms a C shaped curved member with a neck end 147*a* and a shoulder end 149*a* opposite the neck end 147*a*. The neck end 147*a* is attached to the head portion 110 and is spaced apart from the tip portion 113. The shoulder end 149*a* is attached to the base portion 120*a*. The head portion 110 and the handle portion 130*a* are vertically suspended above at least a portion of the upper surface of the base portion 120*a*, such that the inside 111 of the bowl 111 opens in a direction away from the upper surface of the base portion 120*a*. The base portion 120*a* and the bowl 111 are vertically spaced from one another. In other embodiments, the base portion 120*a* and bowl 111 are both vertically and horizontally spaced from one another.

In another embodiment, the supporting elements 140*a* are attached to the lower surface of the base portion 120*a* and are attached to a shoulder end 149*a* and to a handle portion 130*a*. In one particular embodiment, the lower surface of the base portion 120*a* includes a protrusion 122*b* which may be a thickened protruding portion and a tip or a tab which terminates in a contact member that rests on an outside surface 150. The shoulder end 149*a* of the handle portion 130*a*, 131*a* and 132*a* includes a tab 149*a* which also protrudes outwardly from the shoulder end 149*a* and the handle portion 130*a* and is opposite the neck end 147*a*. Here, the tab 149*a* helps the flatware remain in equilibrium and comes into contact with an outside surface 150 when the flatware contains food 305 and is in a weighted state 300, but the tab 149*a* is usually away from the outside surface 150 when the flatware is in a relaxed state 200.

In one embodiment, the protrusion 122*b* extending outwardly from the lower surface of the base portion 120*a* is structurally configured to engage with the outside surface 150 in both the weighted state 300 and the relaxed state 200. The tip terminating in a contact member is structurally configured to engage with the outside surface 150 in the relaxed state 200. The tab protruding outwardly from the shoulder end 149*a* is structurally configured to engage with the outside surface 150 in the weighted state 300.

In some embodiments, the supporting elements 140*b* are the elements that help support the flatware 100 rest on an external and outside surface 150 while staying self-balanced and remaining in equilibrium when there is either food or other material on the flatware in a weighted state 300 and when the flatware is empty and does not contain anything in a relaxed state 200. In some embodiments, the supporting element 140*b* can be just one supporting element 140*b* and can be the same as a base portion 120*b* such that the flatware 100 remain in equilibrium thanks to a combined base portion 120*a* and supporting element 140*b*. In other embodiments, the supporting element 140*b* is a combination of one or more supporting elements 140*b* such as a leg or multiple legs 141*b*.

In one embodiments, the supporting elements 140*b* and the base portion 120*b* are the same elements whereas in other embodiments, the supporting elements 140*b* are elements which are separate from the base portion 120*a*, in yet another embodiment some supporting elements 140*b* can be located on a base portion 120*a* whereas in other embodiments, the supporting elements 140*b* are locate away from the base portion 120*a*.

FIGS. 1 and 2 show one flatware embodiment where the neck end 147*a* of the handle portion 130*a* has wings that extend outwardly 148*a*. These wings can help a user handle the flatware in an ergonomic fashion. The wings can also be used to set the flatware on the edge of an external dish or a resting surface (not depicted here). In this embodiment, and thanks to the wings and flatware configuration, the flatware can rest on a mug, edge of an external dish such as a pan, saucepan or bowl all while remaining in equilibrium in both a relaxed and weighted state.

In another embodiment, the curved member of the handle 131*a* is arched or has an arcuate configuration and a stem portion 132*a* which terminated in opposing outwardly extending wings 148*a* at the neck end 147*a* and the shoulder end 149*a*. In a particular embodiment such as the one depicted in FIGS. 1 and 2, the stem portion 132*a* has a central region which is substantially planar, has a planar and flat configuration of substantially uniform thickness. In other embodiments, the stem portion 132*a* and handle 131*a* can be linear, polygonal or rectangular and can have varying thickness throughout or have a round and cylindrical shape such as a straw.

Figure 3:
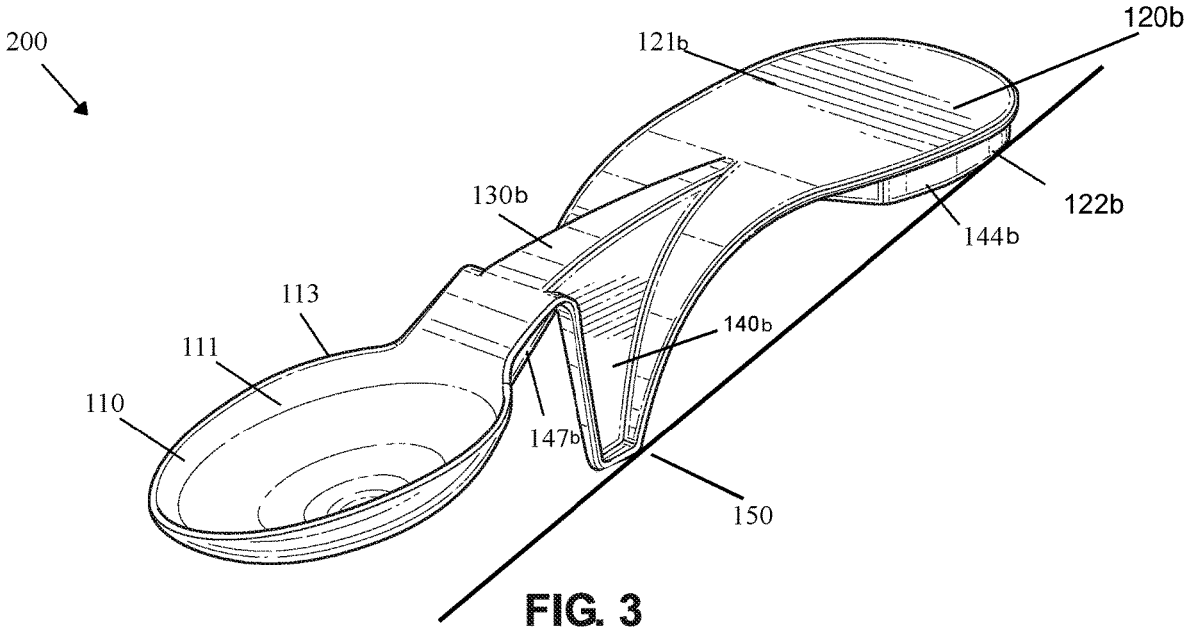
FIG. 3 is a perspective view of another embodiment of the present invention.
Figure 4:
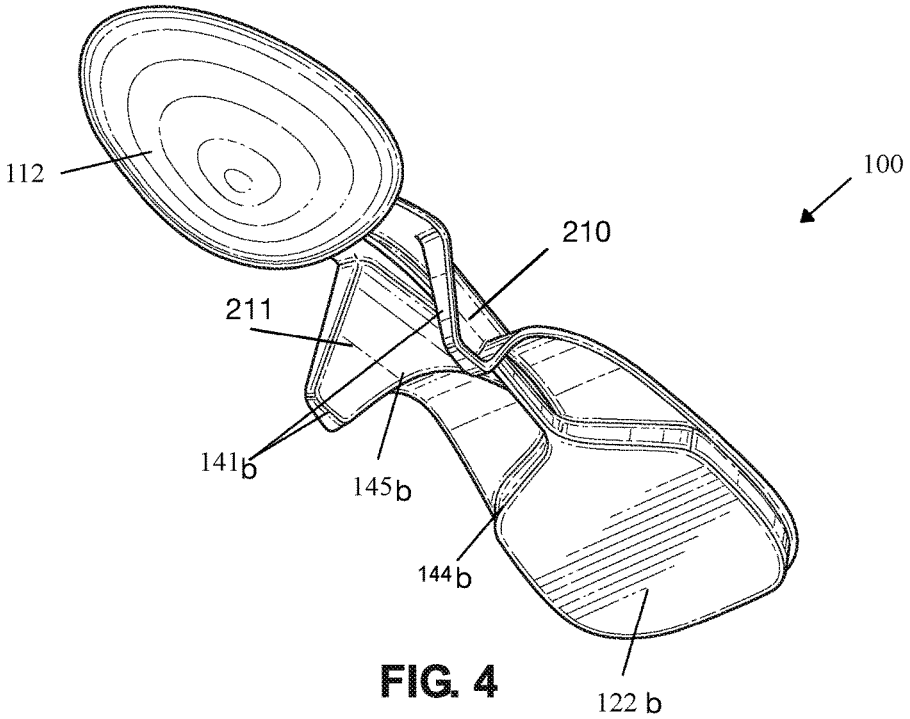
FIG. 4 is a bottom perspective view of FIG. 3.

In one embodiment, the base portion 120*a* of the flatware has an upper portion 121*a* and a bottom portion 122*a* and the upper portion 121*a* has an opening, indentation or cavity which is capable to receiving the complimenting shape of the lower portion 122*a* of a base portion 120*a*. These complementary shapes facilitate the stacking of the flatware on top of one another. While FIGS. 1 and 2 show these complimentary shapes as a protrusion and a cavity, FIGS. 3 and 4 show the complementary shapes as the inner and outer portion of legs 141*b* that the flatware can stand on and stack on top of other flatware. In other embodiments, the complementary shapes can be a peg and a hole, or any other shaped protrusion and cavity, can be v-shaped, circular, linear or of any other polygonal shape.

In one embodiment, the head portion 110 remains suspended and at a distance from an outer surface 150 when holding a weight equivalent to one tablespoon of water. In other embodiments, the weight can be more or less depending on the shape of the flatware and the material used for making the flatware.

In some embodiments, the flatware is made of a material that is freezeproof, waterproof, recyclable, heatproof, reusable, flexible, rigid, semi-rigid and/or rustproof. In some embodiments, no matter how hot or cold a food or fluid is, the temperature of the food does not propagate to the handle or other portions of the flatware.

In all embodiments, the flatware is ergonomically designed to comfortably rest in a user's hand.

In some embodiments, the flatware has a suspended head portion 110 that never touches the table surface when holding one or more of a fluid or a food and includes a handle portion 130*b* or shank that connect the head portion 110 of the flatware to the base portion 120*a* of the flatware. In one embodiment, the support or supporting elements 140*b* along with a base portion 120*a* hold the flatware it in equilibrium or in stationary position when the spoon is holding food or fluid and when the spoon is empty. In other embodiments, only the base portion 120*a* or only the supporting elements 140*b* help the flatware remain in equilibrium in both a weighted state and in a relaxed state. In some embodiments, the spoon does not flip over and does not tip when holding food and/or fluid regardless of the weight of the fluid.

Moving now to FIGS. 3 and 4 is one embodiment of the present disclosure. In this embodiment, the flatware has a head portion 110, a base portion 120*b*, a handle portion 130*b* connecting the head portion 110 to the base portion 120*b*, and a plurality of supporting elements 140*b* supported by an outside surface 150. Here, the supporting elements 140*b* are attached to the handle portion 130*b* and the base portion 120*b*. The weighed state 300 is defined as a state of equilibrium when the flatware and the head portion 110 is holding a food or a fluid. The relaxed state 200 is defined as a state of equilibrium when the head portion 110 is empty. In this embodiment, both the base portion 120*b* and the supporting elements 140*b* help the flatware stay in equilibrium and help the head portion 110 remain at a distance and spaced away from an outside surface 150 in both the relaxed state and the weighted state.

In one embodiment, the base portion 120*b* of the flatware has a thickened portion 144*b* of substantially uniform thickness to help the flatware remain in equilibrium in both a weighted and a relaxed state. In another embodiment, the base portion 120*b* has an upper portion 121*b* and a lower portion 122*b* spaced apart by the thickened portion 144*b*. The lower portion 122*b* is structurally configured to be engageable with the outside surface 150 and can rest on a table, kitchen counter, serving tray or other outside and external surfaces.

In one particular embodiment, the supporting elements 140*b* are two parallel legs 141*b* connected to the handle portion 130*b* and the head portion 110 such that when the flatware is in a relaxed state, the base portion 120*b* and supporting elements 140*b* are supported by the outside surface 150, and when the flatware is in a weighted state, the base portion 120*b* and the head portion 110 are spaced from the outside surface 150, and the supporting elements 140*b* supported by the outside surface 150 in a seesaw-like motion. In other embodiments, the supporting element 140*b* can be just one leg or three or more legs 141*b*.

In another embodiment, the handle portion 130*b* connects the supporting elements 140*b* to the base portion 120*b* and comprises an arcuate configuration spaced from the outside surface 150 in both the weighted state and the relaxed state.

In one embodiment where part of the supporting elements 140*b* are legs 141*b* such as the ones shown in FIGS. 3 and 4, the legs 141*b* are parallel and each leg has an inner potion 211 and an outer portion 210. The inner portions 211 of the parallel legs 141*b* face each other while the outer portion 210 of the parallel legs 141*b* face away from one another.

Figure 7:
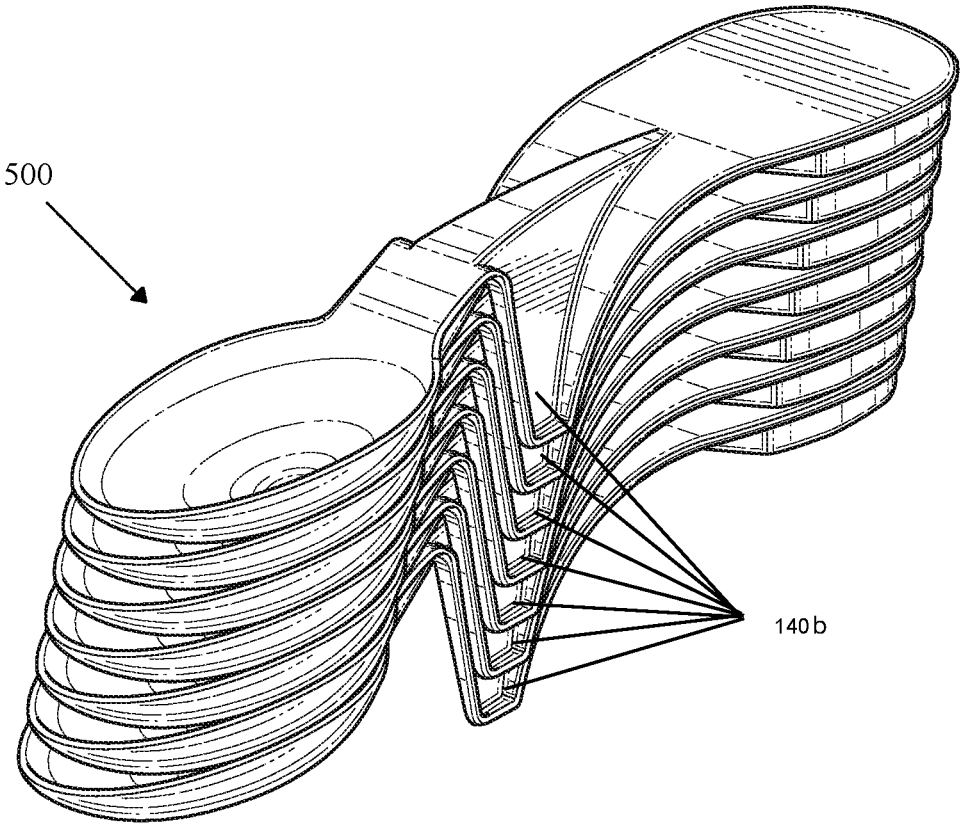
FIG. 7 is a perspective view of another embodiment of a kit of stacked flatware.
Figure 8:
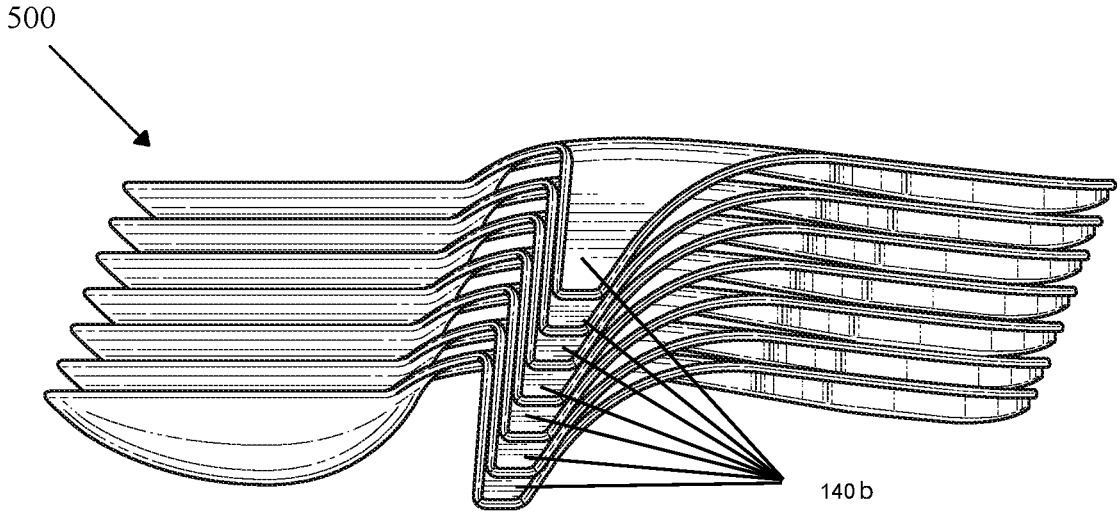
FIG. 8 is a side view of a kit of stacked flatware, showing an alternative embodiment.
Figure 10:
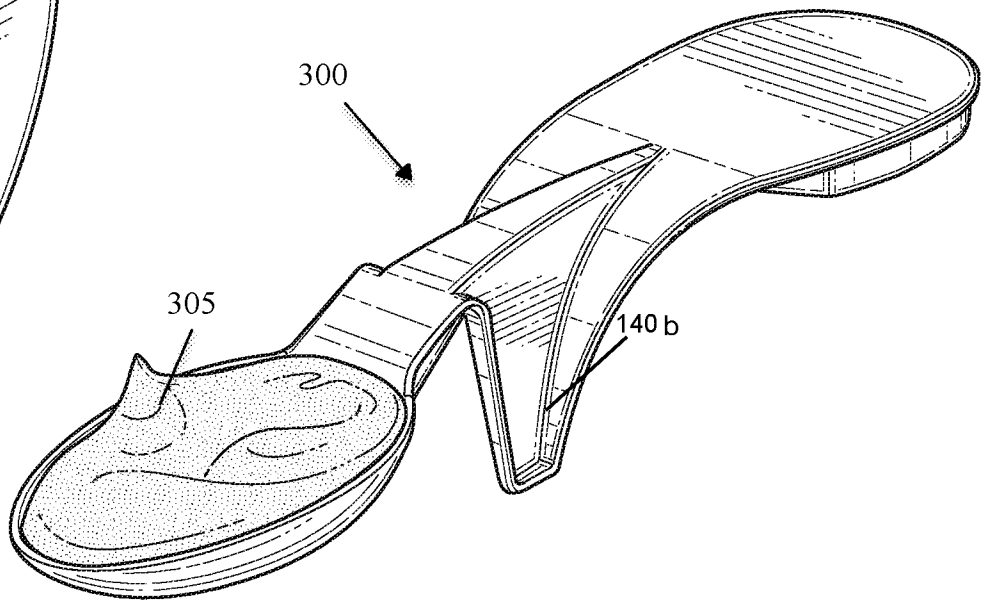
FIG. 10 is a top perspective view of an alternative flatware embodiment holding food.
Figure 9:
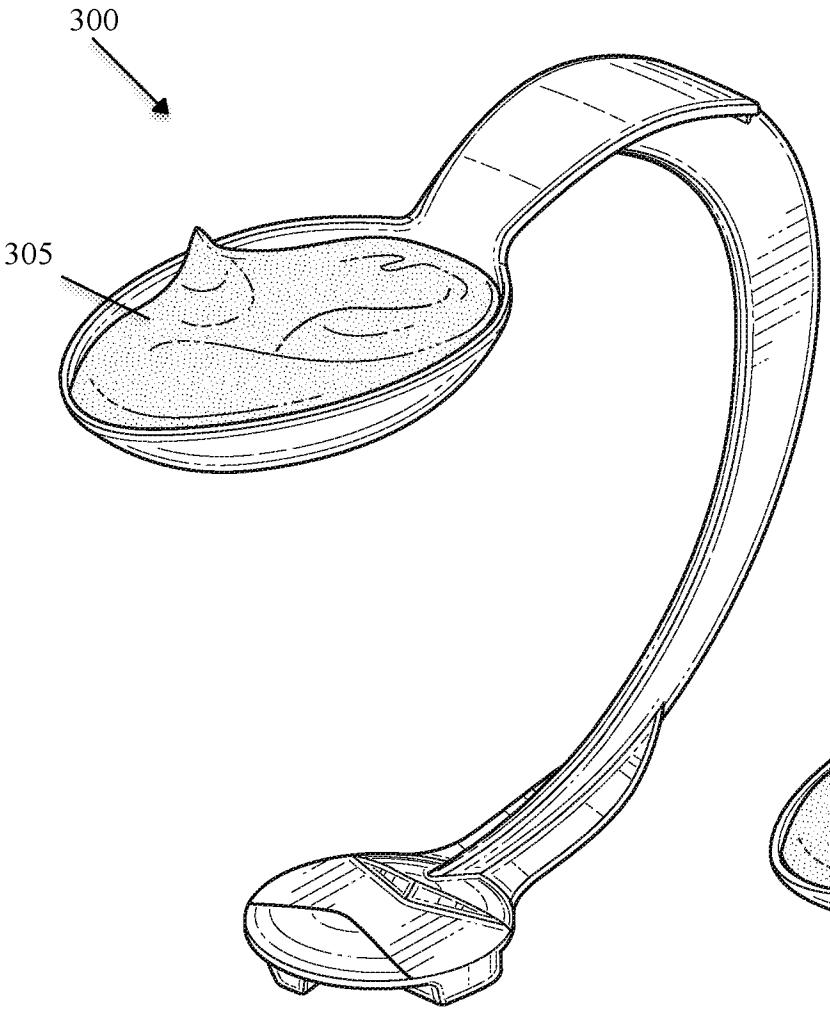
FIG. 9 is a top perspective view of a flatware embodiment holding food.

The two parallel legs 141*b* form a cavity 145*b* such that similar flatware can be stacked 500 on one another as shown in FIGS. 7 and 8.

In another embodiment, the supporting elements 140*b* also have a top portion and a bottom portion where at least part of the bottom portion of the supporting element 140*b* is structurally configured to engage with the outside surface 150 and where the top portion of the supporting elements 140*b* defines a neck 147*b* connecting the supporting elements 140*b* to the head portion 110. The neck 147*b* connecting the supporting elements 140*b* to the head portion 110 is structurally configured to rest ergonomically on a user's hand, an edge of an external dish, a coffee mug, a pan, and/or a resting surface. In one embodiment, the flatware can rest on the edge of the external dish thanks to the neck 147*b* and remain in equilibrium while resting on the dish in both a relaxed state and weighted state.

In one embodiment, the bottom of a flatware complements the shape of an external serving tray such that the flatware can rest or be snapped or coupled to an external serving tray. FIG. 5 shows a particular embodiment of a flatware on a serving tray.

In one embodiment, a kit 500 of flatware is a kit where two or more identical flatware are stacked on one another. In another embodiment, the kit of flatware is a kit where two or more similar but not identical flatware are stacked on one another. Each flatware of the kit includes a head portion 110, a base 120, a handle 130 connecting the head portion 110 to the base, a plurality of supporting elements 140*b* supported by an outside surface 150. The plurality of supporting elements 140*b* are attached to either the handle or the base or both the handle and the base. In one embodiment, the plurality of supporting elements 140*b* and the base hold the flatware kit in equilibrium in both a relaxed state and a weighted state. In other embodiments, the head portions 110 are spaced from one another and from the outside surface 150 when the flatwares are stacked on one another.

In an alternative embodiment where a flatware kit includes two or more identical flatware, the base portion 120*b* further includes an upper portion 121*b* and a lower portion 122*b*, the lower portion 122*b* being structurally configured to be engageable with the outside surface 150 or the upper portion 121*b* of another identical stacked flatware and the plurality of supporting elements 140*b* are two parallel legs 141*b* connected to the handle portion 130*b* and the head portion 110. In this embodiment, each leg 141*b* has an inner portion 211 and an outer portion 210 opposite the inner portion 211 of the leg 141*b*, where the outer portion 210 faces outwardly from the inner portion 211 and where the outer portion 210 of each leg 141*b* forms a cavity adapted to receive the inner portion 211 of the leg 141*b* of another identical flatware. Two or more identical flatware are configured to be vertically stacked on one another.

In yet another embodiment where a flatware kit 500 includes two or more identical flatware, the base portion 120*b* also includes an upper portion 121*a* and a lower portion 122*a*, the upper portion 121*a* forming a cavity or indentation and the lower portion 122*a* further including a protrusion structurally configured to be engageable with the cavity of another identical stacked flatware, making them easy to stack and stay on top of one another. In an another embodiment, the flatware kit is made of two or more flatware where the cavity further includes a first v-shaped defining edge and a second v-shaped defining edge structurally spaced and facing away from one another such that the protrusion of another identical flatware to facilitate stacking of another identical flatware at an angle and such that when stacked on one another, the flatware form a semi-circle together, or a portion of a circle or other shape. The flatware can be stacked at angle and horizontally spaced away from one another thereby forming a portion of a circle. In certain embodiments, the stacking of the flatware is done on the base of another flatware and can be stacked on identical flatwares or other flatwares with bases adapted to In yet another embodiment, the flatware kit is a kit including two or more flatware stackable on one another where each flatware includes a head portion 110, a base portion 120*b*, a handle portion 130*b* connecting the head portion 110 to the base portion 120*b*, on or more supporting elements 140*b* supported by an external surface 150, and where the supporting elements 140*b* are attached to either the handle portion 130*b* or the base portion 120*b* or both the handle portion 130*b* and the base portion 120*b*. When the top flatware of a flatware kit holds food or fluid or equivalent, the kit is in a weighted state and the head portion 110 is either spaced away from the flatware below it or touches the flatware below it, but in all cases, the head portion 110 of the bottom flatware does not touch an external surface or outside surface 150. Similarly, when the top flatware of a flatware kit is empty, the kit is in a relaxed state and the head portion 110 is either spaced away from the flatware below it or touches the flatware below it, but in all cases, the head portion 110 of the bottom flatware does not touch an external surface or outside surface 150.

As mentioned above, other embodiments and configurations may be devised without departing from the spirit of the invention and the scope of the appended claims.

In addition, those skilled in the art will appreciate that the mechanisms of some of the subject matter described herein may be capable of being distributed as a single flatware or a flatware kit. As mentioned above, other embodiments and configurations may be devised without departing from the spirit of the invention and the scope of the appended claims.

The invention claimed is:

1. A flatware comprising:

a) a head portion;

b) a base portion;

c) a handle portion connecting said head portion to said base portion;

d) a plurality of supporting elements configured to rest on an outside surface, said plurality of the supporting elements coupled to the handle portion and the base portion; and e) wherein the flatware is in a weighted state when the head portion is holding a portion of food or fluid; the flatware is in a relaxed state when the head portion is empty; when the flatware is in the weighted state, a weight of the portion of food or fluid held by the head portion is a value that allow weights of said base portion, said handle portion, and said plurality of the supporting elements to counterbalance a weight of said head portion plus the weight of the portion of food or fluid held by the head portion and hold said head portion spaced away from the outside surface, and wherein each one of the supporting elements comprises an inner portion and an outer portion opposite the inner portion, wherein the outer portion faces outwardly from the inner portion of the same supporting element, the outer portion of each of the supporting elements defines a cavity adapted to respectively receive an inner portion of a supporting element of another identical flatware.

2. The flatware of claim 1, wherein the head portion, the base portion, the handle portion and the plurality of supporting elements are formed of a same material.

3. The flatware of claim 1, wherein the base portion further comprises:

i) a thickened portion of substantially uniform thickness;

ii) an upper portion and a lower portion spaced apart by the thickened portion, wherein in the relaxed state a weight of the lower portion is adapted to counterbalance a weight en of said head portion and bring the lower portion to rest on the outside surface, wherein in the weighted state said weights of said handle portion, said supporting elements, said head portion plus the portion of food or fluid held by the head portion counterbalance a weight of said base portion and hold said lower portion spaced away from the outside surface.

4. The flatware of claim 1, wherein the supporting elements are two parallel legs connected to said handle portion and said base portion.

* * * * *